US006802633B1

(12) United States Patent
VandenBossche

(10) Patent No.: US 6,802,633 B1
(45) Date of Patent: Oct. 12, 2004

(54) FLASHLIGHT MOUNTING APPARATUS FOR A SAILBOAT

(76) Inventor: Daniel J. VandenBossche, 48640 Harbor Dr., New Baltimore, MI (US) 48047

( * ) Notice: Subject to any disclaimer, the term of this patent is extended or adjusted under 35 U.S.C. 154(b) by 0 days.

(21) Appl. No.: 10/605,129

(22) Filed: Sep. 10, 2003

(51) Int. Cl.[7] ..... F21V 21/088
(52) U.S. Cl. ..... 362/477; 362/191; 362/396
(58) Field of Search ..... 362/190, 191, 362/287, 396, 427, 477; 248/229.13, 229.17, 229.23, 230.4, 230.8, 231.51, 540, 541

(56) References Cited

U.S. PATENT DOCUMENTS 1,471,985 A * 10/1923 Tower ..... 248/229.23
1,846,345 A * 2/1932 McCarten ..... 362/396
5,508,895 A * 4/1996 Wagoner, Jr. ..... 362/477

* cited by examiner

*Primary Examiner*—Y MY Quach Lee

(57) ABSTRACT

A flashlight mounting apparatus (12) for securing a flashlight (14) to a support member (16, 22) of a sailboat (10) is provided. The flashlight mounting apparatus (12) includes a boat clamping mechanism (24) for selectively attaching the flashlight mounting apparatus (12) to the support member (16, 22) of the sailboat (10). This boat clamping mechanism (24) can be slidably or rotatably adjusted on the support member (16, 22). Furthermore, the flashlight mounting apparatus (14) includes a flashlight clamping mechanism (26) that is coupled to the boat clamping mechanism (24). This flashlight clamping mechanism (26) is intended to hold the flashlight (14) for illuminating a dimly lit portion of the sailboat (10). Also, this flashlight clamping mechanism (26) can be rotatably adjusted relative the boat clamping mechanism (24).

18 Claims, 4 Drawing Sheets

FLASHLIGHT MOUNTING APPARATUS FOR A SAILBOAT

BACKGROUND OF INVENTION

The present invention relates generally to wind indicators for sailboats, and more particularly to a flashlight mounting apparatus for improving the visibility of the wind indicators in dimly lit conditions.

Wind indicators that are intended to assist a skipper in trimming the sails of his sailboat for the purpose of harnessing the power of the wind are well known. These wind indicators can include jib telltales, mainsail telltales, draft telltales, leech telltales, and windexes.

Each telltale typically is a length of yarn or ribbon that is attached to a portion of the sail. Ordinarily, a series of telltales are attached to the sail along the height of the sail. For example, three jib telltales can be respectively attached to a jib at one quarter of the jib's height, half of the jib's height and three quarters of the jib's height. However, more or less than three telltales may be attached to different portions of the jib or various other sails as desired.

The telltales are intended to indicate whether the windflow across the sail is a laminar flow or a turbulent flow. Specifically, the telltales indicate a laminar flow when the telltales flow generally straight backward and conversely a turbulent flow when the telltales do not flow generally straight backward. A person of ordinary skill in the art understands that the laminar flow of air across the sail generates a substantially greater amount of lift to the sail than the turbulent flow of air. This lift is beneficial because the sail is an airfoil positioned on its end, which can receive the lift thereby propelling the sailboat forward. This result occurs even when the sailboat is headed in a windward, or upwind, direction.

Furthermore, the windex typically is a small weather vane mounted to the top of the mast. This windex is intended to show the general direction from which the wind is coming.

This windex and the telltales collectively inform the skipper of the wind conditions and allow him to determine how he will trim his sails and propel his sailboat in a desirable direction at a desirable speed. For example, a skipper participating in a sailboat race usually trims his sails for receiving maximum lift and propelling the sailboat at a maximum speed. Unfortunately, however, it can be rather difficult to see the telltales in dimly lit conditions, e.g. night. Specifically, the skipper may not notice that the telltales are indicating turbulent flow over the sails. For this reason, the skipper may fail to adjust his sails accordingly thereby failing to provide his sails with the maximum possible lift. Therefore, the sailboat may not be traveling at its maximum speed. This result can be especially disadvantageous during sailboat races.

One proposed solution requires that one or more handheld flashlights illuminate the telltales of the sail. In particular, one or more crewpersons can each hold a flashlight to illuminate the telltales. A drawback of this proposed solution is that the crewperson holding the flashlight typically cannot perform other duties while illuminating the telltales. Moreover, even if the crewperson can perform other duties, he can become distracted with holding the flashlight and consequently perform his other duties inadequately.

It is therefore highly desirable to provide a flashlight mounting apparatus that allows for improved visibility of the wind indicators in poorly lit conditions and also eliminates the need for a crewperson to hold the flashlight.

SUMMARY OF INVENTION

The present invention provides a flashlight mounting apparatus for securing a flashlight to a support member of a sailboat. The flashlight mounting apparatus includes a boat clamping mechanism for selectively attaching the flashlight mounting apparatus to the support member of the sailboat. This boat clamping mechanism can be slidably or rotatably adjusted on the support member. Furthermore, the flashlight mounting apparatus includes a flashlight clamping mechanism that is coupled to the boat clamping mechanism. This flashlight clamping mechanism is intended to hold the flashlight for illuminating a dimly lit portion of the sailboat. Also, this flashlight clamping mechanism can be rotatably adjusted relative to the boat clamping mechanism.

One advantage of the present invention is that a flashlight mounting apparatus has been provided that can improve visibility of the wind indicators, e.g. telltales, of a sailboat thereby allowing for the operation of the sailboat in poorly lit conditions.

Another advantage of the present invention is that a flashlight mounting apparatus has been provided that secures a flashlight in a desired position so as to eliminate the need for an individual to hold the flashlight in the desired position.

Yet another advantage of the present invention is that a flashlight mounting apparatus has been provided that is adjustable in various directions of motion thereby allowing a flashlight mounted therein to be aimed in a variety of directions as desired.

Other advantages of the present invention will become apparent upon considering the following detailed description and appended claims, and upon reference to the accompanying drawings.

BRIEF DESCRIPTION OF DRAWINGS

For a more complete understanding of this invention, reference should now be made to the embodiments illustrated in greater detail in the accompanying drawings and described below by way of examples of the invention.

DETAILED DESCRIPTION

Figure 1:
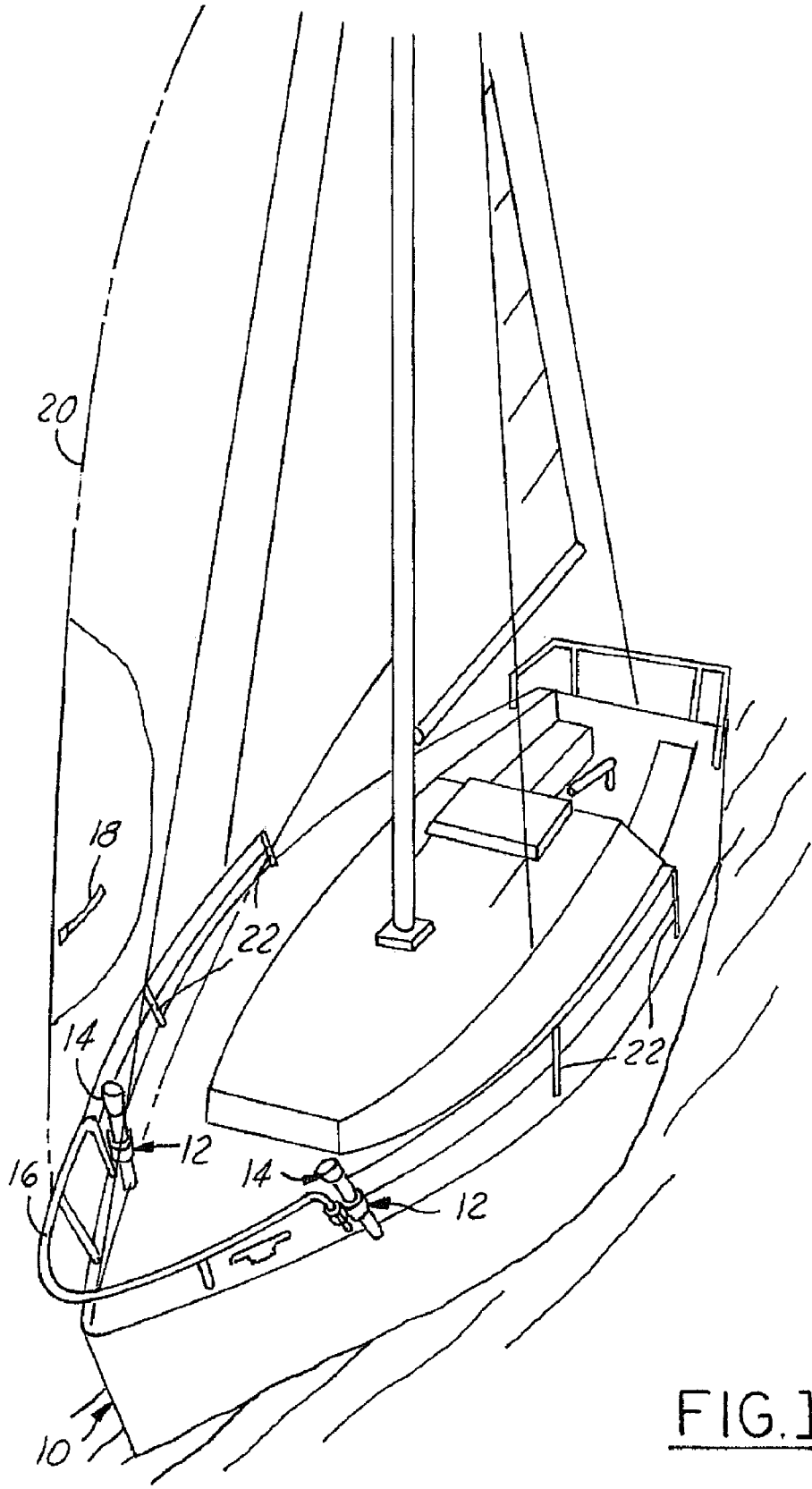
FIG. 1 is a perspective view of a sailboat with a pair of flashlight mounting apparatuses attached to the pulpit of the sailboat, according to one embodiment of the present invention.

In the following figures, the same reference numerals will be used to illustrate the same components in the various views.

Referring to FIG. 1, there is shown a perspective view of a sailboat 10 having a pair of flashlight mounting apparatuses 12 attached to the pulpit 16 of the sailboat 10. Each apparatus 12 is intended to secure a flashlight 14 to a support member of the sailboat 10, e.g. the pulpit 16, for the purpose of securing the flashlight 14 in a position for illuminating various wind indicators. As exemplified in FIG. 1, these wind indicators may be one or more jib telltales 18 extending from a jib 20 of the sailboat 10.

Figure 2:
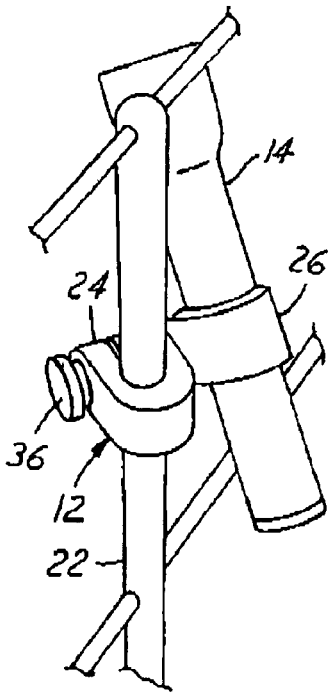
FIG. 2 is a perspective view of the flashlight mounting apparatus shown in FIG. 1, illustrating the flashlight mounting apparatus being attached to a stanchion of the sailboat.

However, it is also understood that the flashlight mounting apparatus 12 can instead be attached to a variety of other support members of the sailboat 10 for illuminating various other objects. For example, as shown in FIG. 2, the flashlight mounting apparatus 12 can be mounted to a stanchion 22 for illuminating other portions of the sailboat 10 as desired. Moreover, it is also understood that the apparatus 12 can couple a variety of other items besides a flashlight to any other suitable framework or to other items as desired.

Figure 3:
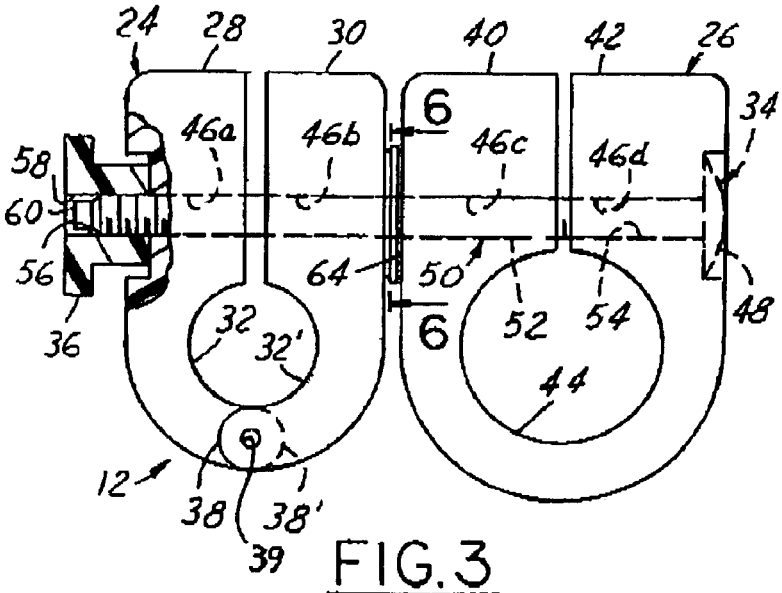
FIG. 3 is a plan view of the flashlight mounting apparatus shown in FIG. 2, illustrating the flashlight mounting apparatus having a boat clamping mechanism and a flashlight clamping mechanism that is coupled to the boat clamping mechanism.

Referring now to FIG. 3, there is shown a plan view of the flashlight mounting apparatus 12 according to one embodiment of the present invention. The apparatus 12 generally includes a boat clamping mechanism 24 and a flashlight clamping mechanism 26 that is rotatably attached to the boat clamping mechanism 24.

Figure 4:
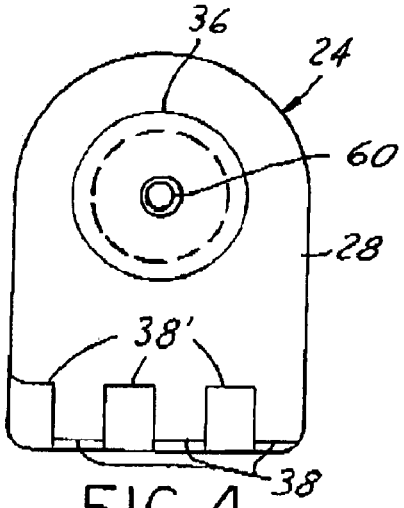
FIG. 4 is a side view of the boat clamping mechanism shown in FIG. 3.

Referring now to FIGS. 3 and 4, the boat clamping mechanism 24 is intended to selectively attach the apparatus 12 to a support member of the sailboat 10. This boat clamping mechanism 24 includes a first bracing member 28 and a second bracing member 30 that is pivotally coupled to the first bracing member 28. Each bracing member 28, 30 includes a contoured surface 32, 32" for engaging the support member of the sailboat 10.

The pivotal coupling between the first bracing member 28 and the second bracing member 30 allows an individual to spread open the boat clamping mechanism 24 and mount the boat clamping mechanism 24 to the support member of the sailboat 10. Specifically, an individual may detach the boat clamping mechanism 24 from the other components of the apparatus 12 and pivot the first bracing member 28 and the second bracing member 30 away from each other so as to expose the countered surfaces 32, 32" of the bracing members 28, 30. This configuration allows the boat clamping mechanism 24 to receive the support member of the sailboat 10. Once the contoured surfaces 32, 32" are positioned adjacent to the support member, the first and second bracing members 28, 30 are pivoted toward each other into a closed position so as to wrap the boat clamping mechanism 24 around the support member. Thereafter, the boat clamping mechanism 24 can be locked in this closed position, as detailed in the description for the bolt member 34 and the knob 36 of the apparatus 12.

In one embodiment, the first and second bracing members 28, 30 are separate components that respectively include a plurality of hinge protrusions 38, 38" extending therefrom for the purpose of pivotally coupling the first and second bracing members 28, 30 to each other. Each hinge protrusion 38, 38" has a hole (not shown) integrally formed therethrough. The hinge protrusions 38, 38" are intended to be positioned so as to align the holes of each protrusion 38, 38" and allow for a pin (not shown) to be inserted into the holes. As a result, the first and second bracing members 28, 30" are pivotally coupled to each other.

According to another embodiment, the first and second bracing members 28, 30 are portions of a one-piece construction. For example, a living hinge element can be in connection between the first and second bracing members so as to provide the pivotal coupling therebetween.

Although only three types of pivotal couplings for the boat clamping mechanism 24 are described, it is understood that various other suitable pivotal couplings can be utilized as desired. Moreover, it is also understood that the boat clamping mechanism 24 can instead be a resilient one-piece construction comprised of a substantially flexible material as desired.

Figure 5:
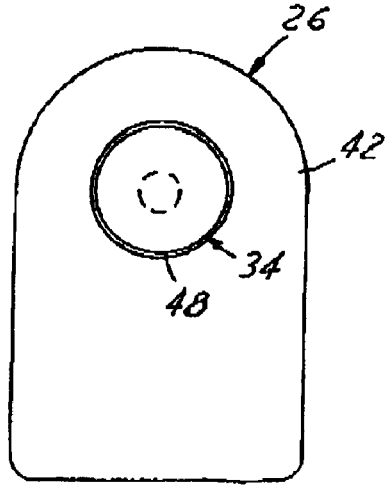
FIG. 5 is a side view of the flashlight clamping mechanism shown in FIG. 3.

Referring now to FIGS. 3 and 5, the flashlight clamping mechanism 26 is a resilient one-piece construction including a first gripping portion 40, a second gripping portion 42, and a flashlight gripping surface 44 extending substantially across the first gripping portion 40 and the second gripping portion 42. The flashlight clamping mechanism 26 is intended to receive a flashlight 14 between the first and second flashlight gripping portions 40, 42 on top of the flashlight gripping surface 44. This surface 44 is shaped for producing a friction fit between the flashlight clamping mechanism 26 and the flashlight 14 when the first and second flashlight gripping portions 40, 42 are forced toward each other in order to sandwich the flashlight 14 therebetween. For example, this surface 44 can have a circular curve that is similar to the handle of the flashlight 14. However, it is understood that the flashlight gripping surface 44 can have a variety of other suitable contours for gripping the handles of flashlights having different shapes and sizes. Forcing the first and second gripping portions 40, 42 toward each other is detailed in the description for the bolt member 34 and the knob 36.

It is understood that the flashlight clamping mechanism 26 can have a variety of other suitable constructions as desired. For example, the flashlight clamping mechanism 26 can instead comprise a multiple-piece mechanism with a hinge device coupled therebetween similar to the boat clamping mechanism 24.

Referring primarily back to FIG. 3, the first and second bracing members 28, 30 of the boat clamping mechanism 24 and the first and second flashlight gripping portions 40, 42 of the flashlight clamping mechanism 26 respectively include four channels 46*a*, 46*b*, 46*c*, and 46*d*. These channels 46*a*, 46*b*, 46*c*, and 46*d* are intended to be aligned together for receiving a bolt member 34 at one end of the apparatus 12 and attaching the bolt member to a knob 36 at an opposing end of the apparatus 12.

Specifically, the combination of the bolt member 34 and the knob 36 is intended to attach the boat clamping mechanism 24 to the flashlight clamping mechanism 26. In addition, this combination is intended to force the first and second bracing members 28, 30 together for the purpose of sandwiching the support member of the sailboat 10 therebetween and causing the boat clamping mechanism 24 to be firmly mounted to the sailboat 10. Moreover, the bolt member 34 and the knob 36 are also intended to force the first and second flashlight gripping portions 40, 42 toward each other so as to sandwich the flashlight 14 therebetween and cause the flashlight clamping mechanism 26 to securely hold the flashlight 14.

This bolt member 34 includes a head portion 48 and a shaft portion 50 extending from the head portion 48. This shaft portion 50 has an external threaded fastener 52 integrally formed thereon and substantially across the length of the shaft portion 50. This external threaded fastener 52 is intended to engage an internal threaded fastener 54 extending into the channel 46*a* of the first bracing member 28. The benefit of this engagement is that it can prevent inadvertent detachment of the bolt member 34 from the boat clamping mechanism 24 when the knob 36 is not fastened to the bolt member 34.

However, it is also understood that the internal threaded fastener may extend from the second bracing member 30, the first gripping portion 40, or the second gripping portion 42 into their respective channels 46*b*, 46*c*, and 46*d*. Specifically, any combination of additional or substitute internal threaded fasteners can be utilized to attach the bolt member 34 to either the boat clamping mechanism 24 or the flashlight clamping mechanism 26 or even both as desired. Alternatively, none of the channels 46*a*, 46*b*, 46*c*, and 46*d* can have internal threaded fasteners extending therein as desired.

The external threaded fastener 52 on the bolt member 34 is also intended to engage an internal threading 56, which extends into an aperture 58 formed through the knob 36. As mentioned above, this engagement allows the combination of the knob 36 and the bolt member 34 to cause the apparatus 12 to be mounted to the sailboat 10, as well as to cause the apparatus 12 to securely hold the flashlight 14 therein.

The shaft portion 50 of the bolt member 34 includes a locating tip 60 that is sized sufficiently small for allowing the tip 60 to be inserted into the aperture 58 of the knob 36 without having to first fasten the external threaded fastener 52 of the bolt member 34 to the internal threading 56 of the knob 36. This feature is beneficial because a user can easily position the knob 36 relative to the shaft portion for twisting the knob 36 and quickly fastening the knob 36 to the bolt member 34.

In other words, the external threaded fastener 52 does not terminate at the end of the shaft portion 50, which could otherwise require an individual to carefully hold the knob 36 adjacent to the bolt member 34 while fastening the knob 36 to the bolt member 34. A person of ordinary skill in the art would understand that this type of hand-held alignment could be somewhat cumbersome in unsteady conditions, which can be common while sailing.

However, it is also understood that the locating construction can instead be incorporated into the aperture 58 of the knob 36 instead of the shaft portion 50 of the bolt member 34. For example, an end portion of the knob 36 can lack internal threading so as to allow the bolt member 34 to be inserted into the aperture of the knob 36 a minimum initial distance without having to first engage the external threaded fastener 52 of the bolt member 34 to the internal threading 56 of the knob 36. Moreover, the apparatus 12 can also completely lack the locating construction as desired.

Figure 6:
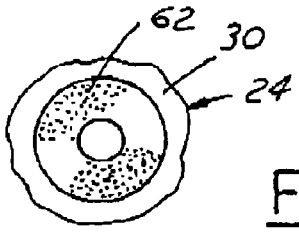
FIG. 6 is a cutaway view of the flashlight mounting apparatus shown in FIG. 3, as taken along line 6—6.

Referring now to FIG. 6, the first gripping portion 40 of the flashlight clamping mechanism 26 includes a first non-skid surface 62 formed thereon adjacent to an end of the channel 46*b*. Likewise, the second bracing member 30 of the boat clamping mechanism 24 includes a second non-skid surface (not shown) adjacent to the channel 46*c*. The first and second non-skid surfaces are intended to contact each other and prevent rotation the flashlight clamping mechanism 26 relative to the boat clamping mechanism 24. These non-skid surfaces are textured surfaces that are integrally formed on each component.

Furthermore, according to another embodiment of the invention, a rubber washer 64 (shown in FIG. 3) is positioned on the bolt member 34 between the first and second non-skid surfaces. This rubber washer 64 is intended to be sandwiched between the first and second non-skid surfaces for the purpose of improving friction between the boat clamping mechanism 24 and the flashlight clamping mechanism 26. As a result, the flashlight clamping mechanism 26 can be more securely held in fixed position relative to the boat clamping mechanism 24.

Figure 7:
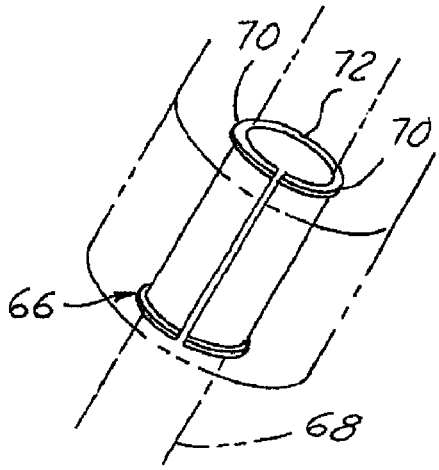
FIG. 7 is a perspective view of a sleeve insert of the flashlight mounting apparatus shown in FIG. 3.
Figure 9:
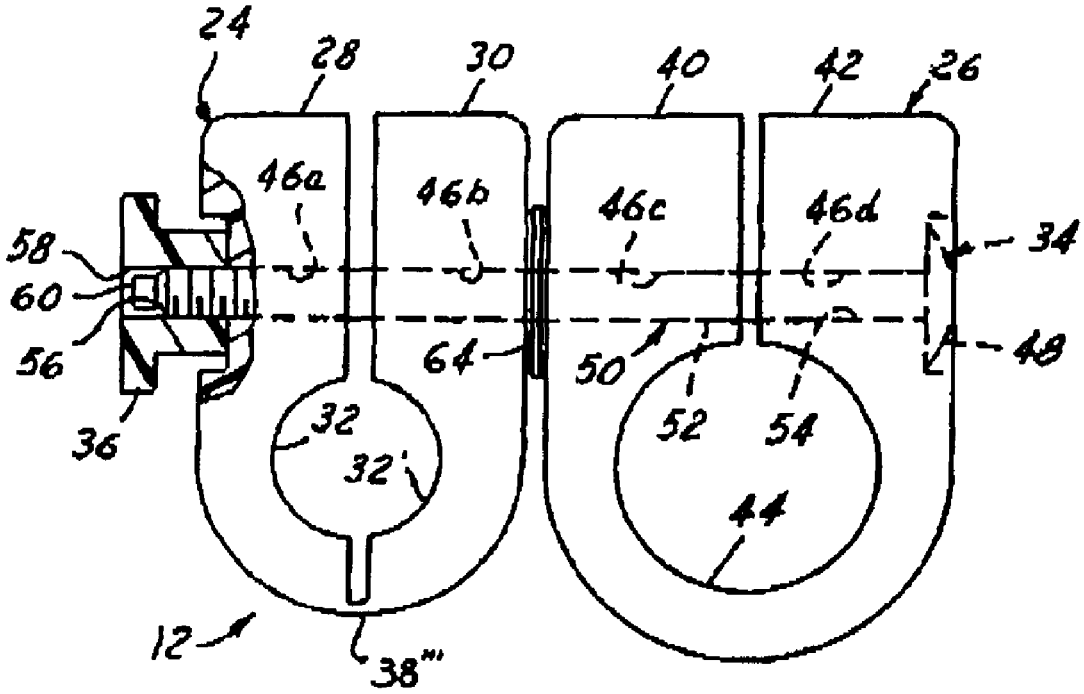
FIG. 9 is a plan view of the flashlight mounting apparatus shown in FIG. 3, according to another embodiment of the present invention.

Referring now to FIG. 7, the apparatus 12 also includes a sleeve insert 66 for permitting attachment of the apparatus 12 to a smaller-sized item 68. For example, the sleeve insert 66 can be wrapped around a smaller-sized flashlight so as to allow the flashlight to be securely held by the flashlight clamping mechanism 26. Alternatively, the sleeve insert 66 can be utilized for surrounding a smaller-sized support member, e.g. stanchion, and permitting the boat clamping mechanism 24 to be mounted to that support member. This sleeve insert 66 can have various sizes for accommodating a variety of smaller-sized items.

The sleeve insert 66 is a one-piece construction including two opposing shell pieces 70, 70" that are attached together by a living hinge element 72. These shell pieces 70, 70" can be wrapped around a smaller-sized item 68 for mounting that item 68 in the apparatus 12. However, it is understood that various other suitable constructions can be utilized as desired.

Figure 8A:
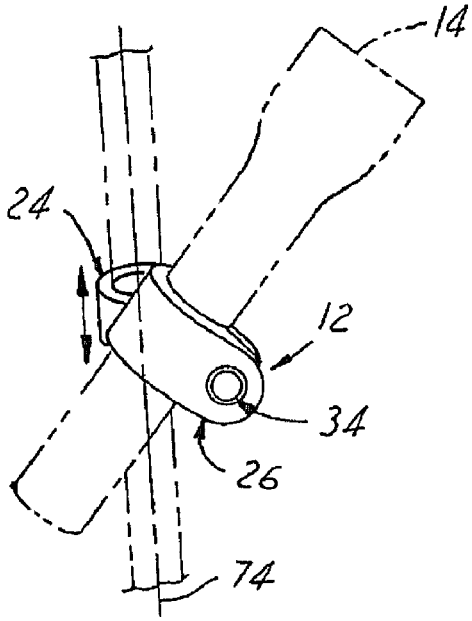
FIG. 8A is a perspective view of the flashlight mounting apparatus shown in FIG. 3, illustrating the linear adjustability of the flashlight mounting apparatus along the longitudinal axis of a support member of the sailboat.
Figure 8B:
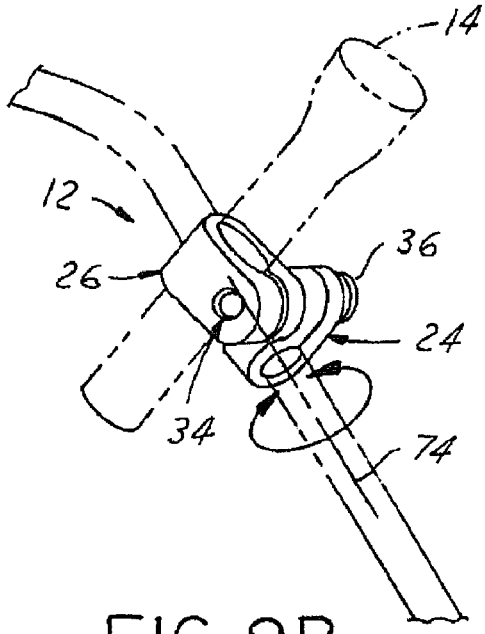
FIG. 8B is a perspective view of the flashlight mounting apparatus shown in FIG. 3, illustrating the rotational adjustability of the flashlight mounting apparatus with respect to the longitudinal axis of a support member of the sailboat.
Figure 8C:
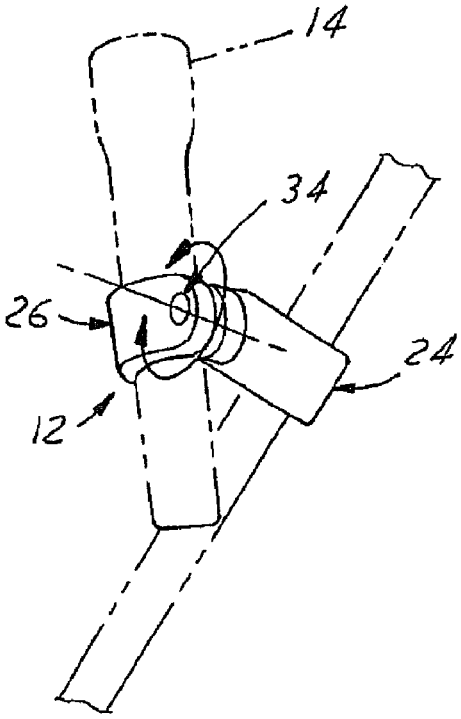
FIG. 8C is a perspective view of the flashlight mounting apparatus shown in FIG. 3, illustrating the rotational adjustability of the flashlight clamping mechanism with respect to the boat clamping mechanism.

Referring now to FIGS. 8A–8C, there are shown perspective views of the flashlight mounting apparatus 12, illustrating three exemplary directions of adjustability. First, the knob 36 can be sufficiently loosened on the bolt member 34 so as to decrease the forces that cause the first and second bracing members 28, 30 to sandwich the support member therebetween and selectively fixedly secure the boat clamping mechanism 24 to that particular position on the support member. Loosening the knob 36 can also decrease the friction between the boat clamping mechanism 24 and the flashlight clamping mechanism 26 thereby permitting rotational movement relative to each other.

Thereafter, as illustrated in FIG. 8A, the apparatus 12 can be adjusted along the longitudinal axis 74 of the support member. In addition, as shown in FIG. 8B, the apparatus 12 can be rotated about the longitudinal axis 74 of the support member. Finally, the flashlight clamping mechanism 26 can also be rotated relative to the boat clamping mechanism 24. The benefit of these various degrees of movement is that a flashlight 14 can be mounted to a particular section of the sailboat 10 while still being capable of illuminating various portions of the sailboat 10. Once the flashlight 14 is placed in the desired position, the user can tighten the knob 36 on the bolt member 34 so as to secure the flashlight 14 in the desired position.

While the invention has been described in terms of preferred embodiments, it will be understood, of course, that the invention is not limited thereto since modifications may be made by those skilled in the art, particularly in light of the foregoing teachings.

What is claimed is:

1. A flashlight mounting apparatus for securing a flashlight to a support member extending from a sailboat, comprising:

a boat clamping mechanism having a first bracing member and a second bracing member pivotally coupled to said first bracing member, each of said first bracing member and said second bracing member having a contoured surface for gripping the support member therebetween and selectively coupling the flashlight mounting apparatus to the support member of the sailboat, said boat clamping mechanism being selectively slidable and rotatable relative to the support member; and a flashlight clamping mechanism coupled to said boat clamping mechanism, said flashlight clamping mechanism having a resilient one-piece construction with a first gripping portion, a second gripping portion, and a flashlight gripping surface extending substantially across said first gripping portion and said second gripping portion, said first gripping portion and said second gripping portion intended to have the flashlight placed therebetween on said flashlight gripping surface, said first gripping portion and said second gripping portion intended to be forced together so as to sandwich the flashlight therebetween and to hold the flashlight for illuminating a dimly lit portion of the sailboat, said flashlight clamping mechanism being selectively rotatable relative to said boat clamping mechanism;

wherein each of said first bracing member, said second bracing member, said first gripping portion, and said second gripping portion have a channel integrally formed therethrough that is intended to receive a bolt member for coupling said boat clamping mechanism to said flashlight clamping mechanism said bolt member also intended to force said first bracing member and said second bracing member together so as to sandwich the support member therebetween, said bolt member also intended to force said first gripping portion and said second gripping portion together so as to sandwich the flashlight therebetween.

2. The flashlight mounting apparatus as recited in claim 1 wherein said first bracing member includes a first plurality of hinge protrusions extending therefrom, said second bracing member including a second plurality of hinge protrusions extended therefrom, each of said first plurality of hinge protrusions and each of said second plurality of hinge protrusions having a hole integrally formed therein for receiving a pin when said first plurality of hinge protrusions are aligned with said second plurality of hinge protrusions.

3. The flashlight mounting apparatus as recited in claim 1 wherein said boat clamping mechanism is a one-piece construction comprising:

said first bracing member;

said second bracing member; and a living hinge element in connection between said first bracing member and said second bracing member.

4. The flashlight mounting apparatus as recited in claim 1 wherein said bolt member is selectively coupled to a knob, said knob and said bolt member being intended to couple said boat clamping mechanism to said flashlight clamping mechanism, said knob and said bolt member also intended to force said first bracing member and said second bracing member together so as to sandwich the support member therebetween, said knob and said bolt member also intended to force said first gripping portion and said second gripping portion together so as to sandwich the flashlight therebetween.

5. The flashlight mounting apparatus as recited in claim 4 wherein said bolt member has an external threaded fastener integrated thereon and substantially across the length thereof, said knob having an aperture formed therethrough with an internal threaded fastener extending therein, said external threaded fastener of said bolt member intended to engage said internal threaded fastener of said knob.

6. The flashlight mounting apparatus as recited in claim 5 wherein said channel within one of said boat clamping mechanism and said flashlight clamping mechanism includes an internal threading for engaging said external threaded fastener of said bolt member and securing said bolt member thereto.

7. The flashlight mounting apparatus as recited in claim 6 wherein said bolt member has an end portion sized substantially small for permitting said end portion to be inserted into said aperture of said knob without coupling said end portion to said internal threaded fastener of said knob.

8. The flashlight mounting apparatus as recited in claim 7 wherein said aperture of said knob has an end portion sized substantially large for permitting said bolt member to be inserted into said aperture without coupling said external threaded fastener of said bolt member to said end portion.

9. The flashlight mounting apparatus as recited in claim 1 wherein said boat clamping mechanism is slidable along and rotatable about a first axis, said flashlight clamping mechanism being rotatable about a second axis that is offset from said first axis.

10. The flashlight mounting apparatus as recited in claim 9 wherein said first axis is perpendicular to said second axis.

11. A flashlight mounting apparatus for securing a flashlight to a support member extending from a sailboat, comprising:

a boat clamping mechanism for selectively coupling the flashlight mounting apparatus to the support member of the sailboat, said boat clamping mechanism being selectively slidable and rotatable relative to the support member; and a flashlight clamping mechanism coupled to said boat clamping mechanism said flashlight clamping mechanism intended to hold the flashlight for illuminating a dimly lit portion of the sailboat, said flashlight clamping mechanism being selectively rotatable relative to said boat clamping mechanism;

wherein said boat clamping mechanism has a first textured surface integrated thereon and said flashlight clamping mechanism has a second textured surface integrated thereon, said first textured surface positioned proximal to said second textured surface, said first textured surface and said second textured surface intended to be selectively forced against each other so as to secure said flashlight clamping mechanism in a fixed position relative to said boat clamping mechanism.

12. The flashlight mounting apparatus as recited in claim 11 wherein said boat clamping mechanism comprises a first bracing member and a second bracing member pivotally coupled to said first bracing member, said boat clamping mechanism intended to grip the support member of the sailboat between said first bracing member and said second bracing member.

13. The flashlight mounting apparatus as recited in claim 12 wherein said first bracing member and said second bracing member each have a contoured surface for gripping the support member therebetween.

14. The flashlight mounting apparatus as recited in claim 13 wherein said flashlight clamping mechanism is a resilient one-piece construction comprising:

a first gripping portion;

a second gripping portion; and a flashlight gripping surface extending substantially across said first gripping portion and said second gripping portion;

wherein said first gripping portion and said second gripping portion are intended to have the flashlight placed therebetween on said flashlight gripping surface, said first gripping portion and said second gripping portion are intended to be forced together so as to sandwich the flashlight therebetween.

15. The flashlight mounting apparatus as recited in claim 14 wherein each of said first bracing member, said second bracing member, said first gripping portion, and said second gripping portion have a channel integrally formed therethrough that is intended to receive a bolt member, said bolt member intended to be selectively coupled to a knob for coupling said boat clamping mechanism to said flashlight clamping mechanism, said bolt member also intended to force said first bracing member and said second bracing member together so as to sandwich the support member therebetween, said bolt member also intended to force said first gripping portion and said second gripping portion together so as to sandwich the flashlight therebetween.

16. The flashlight mounting apparatus as recited in claim 15 wherein said second bracing member of said boat clamping mechanism has said first textured surface integrated thereon adjacent to said channel of said second bracing member, said first gripping portion of said flashlight clamping mechanism having said second textured surface integrated thereon adjacent to said channel of said first gripping portion, said second bracing member of said boat clamping mechanism being positioned proximal to said first gripping portion of said flashlight clamping mechanism.

17. The flashlight mounting apparatus as recited in claim 16 wherein said second bracing member of said boat clamping mechanism and said first gripping portion of said flashlight clamping mechanism include a reinforcement washer coupled therebetween.

18. A flashlight mounting apparatus for securing a flashlight to a support member extending from a sailboat, comprising:

a boat clamping mechanism for selectively coupling the flashlight mounting apparatus to the support member of the sailboat, said boat clamping mechanism being selectively slidable and rotatable relative to the support member;

a flashlight clamping mechanism coupled to said boat clamping mechanism, said flashlight clamping mechanics intended to hold the flashlight for illuminating a dimly lit portion of the sailboat, said flashlight clamping mechanism being selectively rotatable relative to said boat clamping mechanism;

a rubber washer coupled between said boat clamping mechanism and said flashlight clamping mechanism said rubber washer intended to selectively fixedly couple said flashlight clamping mechanism to said boat clamping mechanism; and a sleeve insert selectively coupled to at least one of the support member and the flashlight, said sleeve insert intended to allow a smaller sized flashlight and a smaller sized support member to be coupled to the flashlight mounting apparatus;

wherein said boat clamping mechanism has a first textured surface integrated thereon and said flashlight clamping mechanism has a second textured surface integrated thereon, said first textured surface positioned proximal to said second textured surface with said rubber washer positioned therebetween, said first textured surface and said second textured surface intended to be selectively forced against each other so as to secure said flashlight clamping mechanism in a fixed position relative to said boat clamping mechanism.

* * * * *